US009607746B2

(12) United States Patent
Buerssner et al.

(10) Patent No.: US 9,607,746 B2
(45) Date of Patent: Mar. 28, 2017

(54) ELECTROMAGNETIC ACTUATOR DEVICE

(71) Applicant: ETO Magnetic GmbH, Stockach (DE)

(72) Inventors: Joerg Buerssner, Engen (DE); Philipp Fangauer, Constance (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/012,028

(22) Filed: Aug. 28, 2013

(65) Prior Publication Data

US 2014/0062628 A1 Mar. 6, 2014

(30) Foreign Application Priority Data

Aug. 28, 2012 (DE) ..... 10 2012 107 922

(51) Int. Cl.
*H01F 7/00* (2006.01)
*H01F 7/08* (2006.01)
*H01F 7/16* (2006.01)

(52) U.S. Cl.
CPC ..... *H01F 7/08* (2013.01); *H01F 7/1615* (2013.01); *H01F 7/1638* (2013.01); *F01L 2820/031* (2013.01)

(58) Field of Classification Search
CPC .. H01H 9/443; H01H 1/54; H01H 2051/2218; H01H 50/24; H01H 50/44; H01H 51/2236; H01H 51/2272; H01F 7/06; H01F 7/066; H01F 7/08; H01F 7/122; H01F 7/1646; H01F 7/1615; H01F 7/1684; H01F 2007/185; H01F 2007/1692; H01F 41/02; H01F 5/00; H01F 7/0252; H01F 7/1607
USPC ..... 335/229
See application file for complete search history.

(56) References Cited

U.S. PATENT DOCUMENTS 2,311,715 A * 2/1943 Thorne ..... 324/217
3,460,081 A * 8/1969 Tillman ..... 335/234
3,599,020 A * 8/1971 Harris et al. ..... 310/12.27
3,828,288 A * 8/1974 Boyd ..... G08B 5/22 335/234
4,157,520 A * 6/1979 Moates et al. ..... 335/230
4,164,721 A * 8/1979 Ishida ..... H01F 7/13 335/229
4,208,685 A * 6/1980 Matla et al. ..... 360/266.4
4,321,570 A * 3/1982 Tsunefuji ..... H01F 7/1646 335/229
4,419,643 A * 12/1983 Ojima et al. ..... 335/234
(Continued)

*Primary Examiner* — Shawki S Ismail
*Assistant Examiner* — Lisa Homza
(74) *Attorney, Agent, or Firm* — Bachman & LaPointe, PC

(57) ABSTRACT

An electromagnetic actuator device has a coil unit (28, 58) enclosing a first yoke section (16, 56) of a stationary yoke unit (10, 54), an armature unit (14, 64) movably guided relative to the yoke unit (10, 54), by energization to interact with a positioning partner on the output side of the armature unit (14, 64) and permanent magnetic agents (22, 36, 68) coupled into a magnetic flux circuit of the yoke unit (10, 54) wherein de-energization of the coil unit (28, 58) a permanent magnetic flux circuit through the yoke unit (10, 54) and a section of the armature unit (14, 64) that is free of permanent magnetic flux and energization displaces the permanent magnetic flux, out of the section, wherein the armature unit (14), by spring force is pre-loaded in a direction opposed to permanent magnetic retaining force of the armature unit (14, 64) and the positioning partner is a combustion engine unit.

11 Claims, 4 Drawing Sheets

(56) References Cited

U.S. PATENT DOCUMENTS 4,442,418 A * 4/1984 Myers ..... H01F 7/16 335/230
4,470,030 A * 9/1984 Myers ..... H01F 7/145 335/228
4,550,302 A * 10/1985 Watanabe et al. ..... 335/228
4,604,599 A * 8/1986 Koehler ..... H01F 7/08 335/230
4,609,899 A * 9/1986 Koehler ..... H01H 51/2209 335/230
4,635,016 A * 1/1987 Guery ..... H01F 7/1646 335/230
4,692,999 A * 9/1987 Frandsen ..... 29/596
4,727,344 A * 2/1988 Koga et al. ..... 335/78
4,730,175 A * 3/1988 Ichikawa ..... H01H 51/2209 335/230
4,746,886 A * 5/1988 Uetsuhara ..... 335/230
4,751,487 A * 6/1988 Green, Jr. ..... 335/234
4,779,582 A * 10/1988 Lequesne ..... F01L 9/04 123/90.11
4,797,645 A * 1/1989 Uetsuhara ..... 335/230
4,808,955 A * 2/1989 Godkin et al. ..... 335/222
4,829,947 A * 5/1989 Lequesne ..... F01L 9/04 123/90.11
4,868,432 A * 9/1989 Frandsen ..... 310/12.08
4,881,054 A * 11/1989 Polgar ..... H01H 51/2236 335/230
4,994,776 A * 2/1991 Juncu ..... H01F 7/1646 335/230
5,032,812 A * 7/1991 Banick ..... F16K 31/082 335/17
5,105,326 A * 4/1992 Shimp et al. ..... 361/49
5,155,399 A * 10/1992 Zimmermann ..... 310/23
5,190,223 A * 3/1993 Mesenich ..... 239/585.5
5,196,816 A * 3/1993 Harting et al. ..... 335/78
5,257,014 A * 10/1993 Zimmermann ..... 340/686.1
5,268,662 A * 12/1993 Uetsuhara et al. ..... 335/229
5,303,012 A * 4/1994 Horlacher et al. ..... 335/253
5,345,206 A * 9/1994 Morcos ..... 335/222
5,703,419 A * 12/1997 Mizutani ..... 310/49.33
5,727,769 A * 3/1998 Suzuki ..... 251/129.15
5,787,915 A * 8/1998 Byers et al. ..... 137/1
5,809,157 A * 9/1998 Grumazescu ..... 381/412
5,850,170 A * 12/1998 Kern ..... 335/229
5,896,076 A * 4/1999 van Namen ..... H01F 7/1615 335/222
5,955,934 A * 9/1999 Raj ..... 335/277
5,959,519 A * 9/1999 Gobel ..... H01F 7/1615 335/132
5,969,589 A * 10/1999 Raj ..... 335/277
6,057,750 A * 5/2000 Sheng ..... 335/234
6,199,587 B1 * 3/2001 Shlomi et al. ..... 137/625.5
6,229,421 B1 * 5/2001 Floyd et al. ..... 335/253
6,242,994 B1 * 6/2001 Li et al. ..... 335/277
6,244,298 B1 * 6/2001 Sugita et al. ..... 137/625.43
6,246,561 B1 * 6/2001 Flynn ..... 361/147
6,265,956 B1 * 7/2001 Cascolan ..... H01F 7/1615 335/234
6,424,244 B1 * 7/2002 Hendel ..... H01H 51/2209 335/177
6,816,048 B2 * 11/2004 Morita et al. ..... 335/220
6,836,201 B1 * 12/2004 Devenyi et al. ..... 335/229
6,932,320 B2 * 8/2005 Fukano et al. ..... 251/129.15
6,940,376 B2 * 9/2005 Morita et al. ..... 335/220
7,075,398 B2 * 7/2006 Morita et al. ..... 335/220
7,280,019 B2 * 10/2007 Kolb ..... H01F 7/1615 335/229
7,517,721 B2 * 4/2009 Ito et al. ..... 438/106
7,746,202 B2 * 6/2010 Hagen et al. ..... 335/274
8,013,698 B2 * 9/2011 Bonjean et al. ..... 335/229
8,106,734 B2 * 1/2012 Gruden ..... 335/229
8,159,806 B2 * 4/2012 Cartier-Millon et al. .... 361/139
8,159,807 B2 * 4/2012 Pohl ..... 361/160
8,188,821 B2 * 5/2012 Nelson ..... 335/229
8,363,881 B2 * 1/2013 Godkin ..... 381/414
8,432,242 B2 * 4/2013 Irwin ..... 335/261
8,576,032 B2 * 11/2013 Herbert et al. ..... 335/220
8,729,992 B2 * 5/2014 Schiepp ..... H01F 7/1638 335/229
2002/0093408 A1 * 7/2002 Morita et al. ..... 335/220
2005/0024174 A1 * 2/2005 Kolb et al. ..... 335/220
2005/0168311 A1 * 8/2005 Wright et al. ..... 335/306
2008/0228212 A1 * 9/2008 List ..... 606/182
2009/0128268 A1 * 5/2009 Butler ..... 335/209
2010/0123093 A1 * 5/2010 Beyer et al. ..... 251/129.15
2014/0062628 A1 * 3/2014 Buerssner et al. ..... 335/229

* cited by examiner

ELECTROMAGNETIC ACTUATOR DEVICE

BACKGROUND OF THE INVENTION

The present invention concerns an electromagnetic actuator device as well as the use of such an electromagnetic actuator device as a positioning device for a combustion engine unit.

Electromagnetic positioning devices have been of known prior art for a long time as actuators, in particular for a camshaft positioning unit, or a similar unit of a combustion engine. Thus, for example, the applicant's German patent 102 40 774 shows such a technology, in which an armature unit having a permanent magnetic agent has at its end a tappet or tappet section designed to interact with a positioning partner (for example, a positioning groove of a camshaft adjustment system), and can be moved relative to a static yoke or core unit as a reaction to an energisation of a (stationary) coil unit. In concrete terms the reaction to the energisation in such devices is generated as a repulsive electromagnetic field, which releases the armature unit from an initial position on the yoke unit and drives it in the direction towards an engagement position with the positioning partner.

Such devices of presupposed known art are not only electromagnetic and optimised with regard to their dynamic behaviour (force and velocity development); these devices are also suitable in a particularly beneficial manner for large-scale production.

However, such an approach, as structurally determined, also has disadvantages, which in particular limit the flexibility of the adaptation of this technology to various conditions of deployment. Thus the technology presupposed as of known art, in the first instance the permanent magnetic agents (typically implemented in the form of a permanent magnetic disk or similar) to be provided on the armature and thus movable, requires protection of this armature unit from impacts, shocks or similar, so as to protect the typically brittle permanent magnetic material, and thus to ensure as long a service life as possible. DE 102 40 774, cited as prior art, solves this problem in that the armature-side permanent magnetic disk is bounded on both flat faces by (flux-conducting) metal disks and is additionally encased, so that even severe positive and negative accelerations onto the armature unit do not cause any damage to the permanent magnetic module. At the same time geometric limits are determined by such approaches, which, for example, define typical maximum sizes for such feasibility in the radial or axial directions.

Thus there is a fundamental disadvantage of the technology of known art, namely that for purposes of increasing the forces the armature-side permanent magnetic agents must also be increased in size correspondingly, with the effect that the masses to be moved (by the armature) increase accordingly (in addition to the above-mentioned measures for the mechanical protection of the permanent magnetic material).

SUMMARY OF THE INVENTION

Accordingly the fundamental requirement consists in increasing the flexibility of an electromagnetic actuator device that deploys permanent magnetic agents in terms of its configurability and adaptability, in particular to create the possibility of increasing the armature force without correspondingly increasing the mass to be moved by the armature (by means of correspondingly increased armature-side permanent magnetic agents). At the same time such a device should in particular be suitable for interaction with a positioning unit of a combustion engine, in particular as per further developments it should be able to exercise a camshaft adjustment system.

The object is achieved by means of the electromagnetic actuator device with the features disclosed herein, together with the combustion engine unit adjustment device in accordance with the present disclosure, which likewise should be viewed as an application of an electromagnetic actuator device in accordance with the present invention in a combustion engine context. Advantageous further developments of the invention are also described herein.

In an inventively advantageous manner the invention in the first instance relocates the permanent magnetic agents into the stator, i.e. into the flux-conducting stationary yoke unit; on its first yoke section this carries the stationary coil unit, which itself can suitably be energised, and with which the armature unit, which can move relative to the yoke unit, interacts so as to drive the latter.

In accordance with the invention the electromagnetic actuator device is advantageously configured such that the permanent magnetic agents are coupled into the stationary yoke unit, i.e. form part of a (permanent) magnetic flux circuit consequently formed in the yoke unit. In accordance with the invention the yoke unit configured in this manner serves to ensure that in a de-energised state of the coil unit a section of the armature unit (more exactly: a yoke-side end of the armature unit, designed in the form of a tappet, which itself has no permanent magnetic agents) is part of the permanent magnetic flux circuit, accordingly therefore the permanent magnetic flux of the stationary permanent magnetic agents also flows through this section of the tappet unit (armature unit) and thus serves to ensure that in the de-energised state a retaining force holding the armature on the yoke unit is exerted.

Likewise in accordance with the invention the energisation of the coil unit advantageously serves to ensure that the permanent magnetic flux is displaced from the armature unit by means of the electromagnetically generated flux, correspondingly the permanent magnetic retaining force onto the armature unit reduces. As a reaction to this can then the spring agent, provided in accordance with the invention, which acts in a suitable manner on the armature unit, can move the armature unit out of the initial position and release the armature unit from the yoke unit, since the related spring force is opposed to the permanent magnetic retaining force and exceeds the latter, with the displacement of the permanent magnetic flux out of the armature section.

The result is that as a result of the action of the spring force the armature unit is brought into the desired end position, or engagement position, with the positioning partner, so that the desired positioning function can reliably be exercised on the combustion engine unit with few components and short switching times.

Here in accordance with the invention, advantageously compared with the prior art called upon, the design of the permanent magnetic agents as stationary permanent magnetic agents can be in addition advantageously be deployed, i.e. integrated, into one or a plurality of sections of the actuator housing, suitably dimensioned for particular purposes, without this having any influence on the armature-side mass to be moved. Thus in the present invention it is in particular possible to influence an armature force without any corresponding influence of an armature-side permanent magnet occurring (which, for example, in the case of an increase would increase the additional mass to be accelerated). In this case it is just the static permanent magnet that must be dimensioned appropriately, here, for example, it must be increased.

In accordance with the invention advantageously, and as per further developments, the inventive integration into the at least in some sections hollow cylindrical housing offers moreover the possibility of implementing suitable housing components with or from the permanent magnetic material, for example a cover section of the housing provided in accordance with further developments, and/or a section of a front face (which then, for example, can be in the form of a ring or a ring section) so that assembly and series production advantages can be implemented.

As a result an actuator device designed to operate together with combustion engine units comes into being that is flexible to dimension and to configure; in particular it provides the possibility of dimensions that increase the magnetic force, without this having a disadvantageous effect on the armature mass (i.e. increasing the mass). As a result it is to be anticipated that the technology, already widely propagated and utilised, of the electromagnetic actuators that have been called upon as the initial technological starting point, can be made accessible to further applications.

In an inventively advantageous further development adjacent flux-conducting agents are assigned to the permanent magnetic agents; these are configured such that (with an appropriate air gap Increasing the flux resistance), for example, the permanent magnetic flux displaced during the energisation of the coil unit can flow via these flux-conducting agents, and thus the magnetic flux characteristics can be additionally optimised.

In a further preferred form of embodiment of the invention provision is made for the first yoke section (with the formation of an intermediately located air gap) to be aligned axially with the extended armature unit, such that a contact point therefore occurs between these sections. In this form of implementation the coil unit enclosing the first yoke section would therefore likewise be located coaxially with the extended tappet unit. With this variant of the invention it is possible to reproduce the form of the technology of known art in a particularly elegant manner, so that in this respect a direct substitution of existing electromagnetic actuators in accordance with the prior art can take place.

Within the context of the invention it is particularly preferred in accordance with further developments to assign adjustment agents to the coil unit that enable particular modes of the energisation, in particular an adjustment of the polarity of the energisation, e.g. a reversal of this polarity. Since the present invention uses the principle of deploying electromagnetically generated magnetic flux for purposes of influencing, in particular for displacing permanent magnetic flux, and such a displacement requires opposing flux directions, the present invention likewise, and as an additional supplemental variant, envisages utilising the aligned fluxes (as a form of superposition) to an increased extent, so as not only to cause an increased retaining effect of the armature unit in a neutral state, initial state or retaining state on the yoke unit, but even if the armature unit is released from the yoke unit to generate a restoring force, i.e. a retraction force acting on the armature unit. This simply presupposes that a superimposed magnetic force (electromagnetic and permanent magnetic) acting on the armature unit in the released state is stronger than a spring force releasing the armature unit from the yoke unit, so that the adjustment agents as per further developments enable for the energisation in particular also a potentially increased current, for example, for the reversed polarity state as a retraction current.

In this manner it is then in addition possible, as per further developments, depending upon the configuration of these adjustment agents for the coil unit, to configure the inventive device as a mono-stable or a bi-stable design.

While one preferred form of implementation of the invention envisages a coil unit as an (individual) coil (for example from the point of view of efficient manufacture), it is equally within the framework of possible forms of embodiment to subdivide or configure the inventive coil unit in the form of a plurality of coils and to connect them together electrically with one another in a suitable manner, so that for example a required number of windings, instead of one large coil can be subdivided into a multiplicity of correspondingly smaller coils. Here too it is possible to ensure suitable geometrical optimisations to meet a particular requirement. Alternatively the first yoke section can be aligned orthogonally to the armature unit (or at another angle, forming an extended angle with the axial direction).

In this manner the present invention is then extremely suitable for effecting an adjustment of the functionality of a combustion engine unit such as, for example, a camshaft, in which, in an installed environment with particular requirements, a dynamic, reliable and operationally secure adjustment functionality can be ensured.

BRIEF DESCRIPTION OF THE DRAWINGS

Further advantages, features, and details of the invention ensue from the following description of preferred examples of embodiment, and also with the aid of the drawings; in the latter.

DETAILED DESCRIPTION

Figures 1, 2, 3:
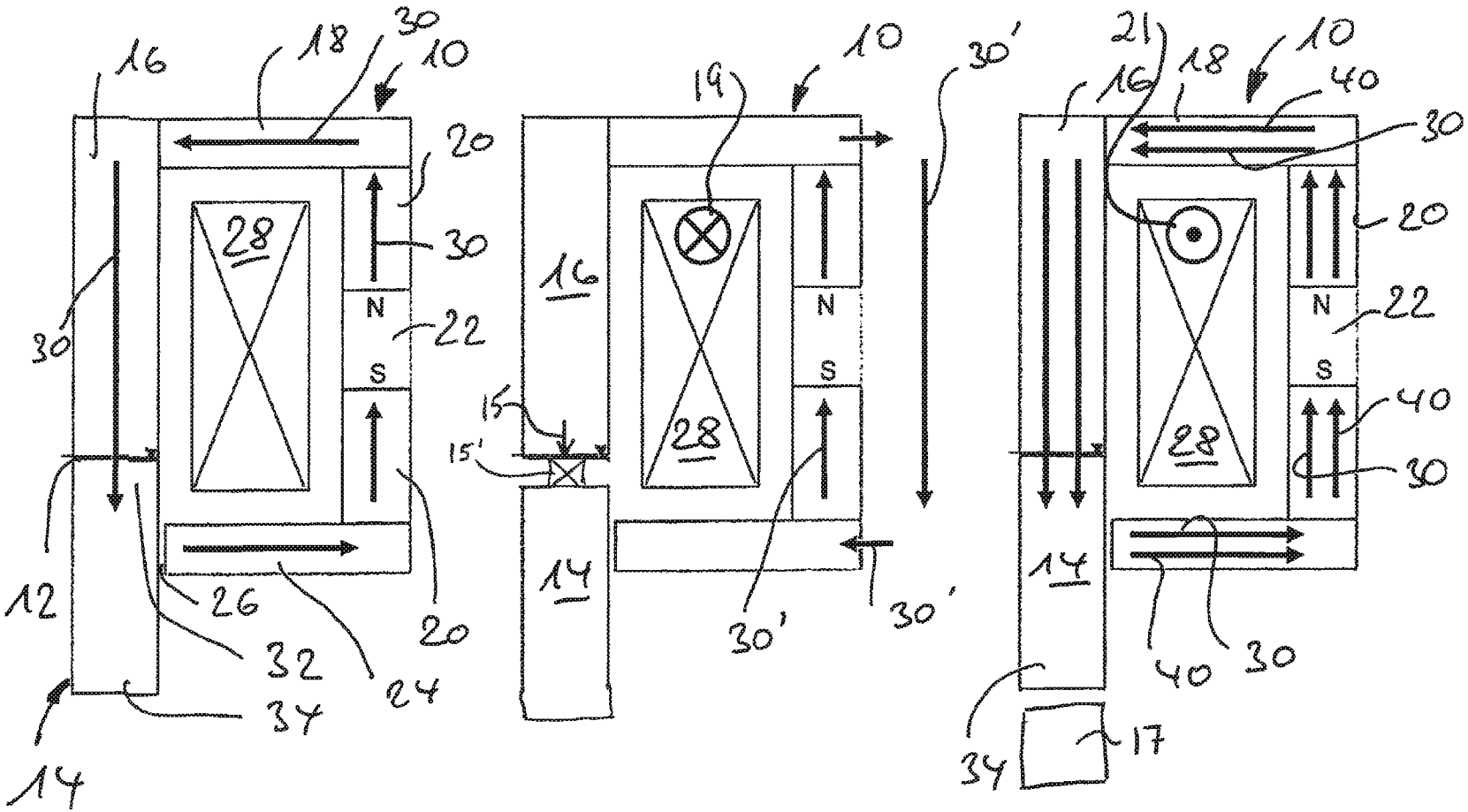
FIG. 1 shows a schematic view of the inventive electromagnetic actuator device with a first example of embodiment with a permanent magnetic unit integrated into the cover surface of the housing, represented in the de-energised operating state of the coil unit.
FIG. 2 shows a representation analogous to FIG. 1 of the first example of embodiment with an energised coil unit and a correspondingly modified magnetic flux.
FIG. 3 shows a schematic representation of the first example of embodiment analogous to FIGS. 1, 2 and, compared with FIG. 2, a reversed polarity energised state, so that instead of a flux displacement an increased magnetic flux flows via the tappet section.

FIGS. 1 to 3 illustrate in schematic form a first form of embodiment of the electromagnetic actuator device in three different operating states. Represented in the figures is a yoke unit 10, consisting of a first yoke section 16 interacting axially across a front face air gap 12 with an extended tappet-type armature unit 14, to which yoke section connects—in the figures transversely—a first front face end section 18; on the cover side the rotationally symmetric (and shown simply in its right-hand region) yoke unit, implemented as a housing, is provided with a cover flux section 20, in which axially magnetised permanent magnetic units 22 are deployed in a flux-conducting manner, as a ring in the example of embodiment represented. Facing the first front face end section 18 a second front face end section 24 is provided, which connects to the cylindrical housing cover or cover flux section 20, and makes the magnetic connection to the armature or tappet unit 14 across a lateral air gap 26.

The device so constructed thus possesses a cylindrical housing defined by sections 18, 20, 24 with a first yoke section 16 designed along the central axis, which axially interacts with the armature tappet unit 14 (which has no permanent magnetic agents). In the housing interior, extending around the unit 14 or section 16, a coil unit is provided in the form of an individual coil 28; in the representations of FIGS. 1 to 3 these are once again just the representations of the right-hand section of the otherwise radially symmetrical arrangements.

The bundle of arrows in FIG. 1 illustrates the permanent magnetic flux 30 through the magnetic circuit; it becomes apparent that the flux of the permanent magnetic unit 22 extends through the cover flux section 20, the front face end sections 18, 24, and also the central yoke section 16, and is closed by an end section 32 of the armature tappet 14 (across the air gaps 12, 26). Accordingly there arises a magnetically attracting, i.e. retaining, force that fixes the armature tappet in the position shown in FIG. 1 (in the de-energised state of the coil). Schematically shown in FIG. 2 is a compression spring 15' acting on the armature unit in its direction of movement (downwards in the plane of the figure), i.e. pre-loading the armature unit in this direction; here the device in accordance with the first example of embodiment is configured such that the permanent magnetic retaining force exceeds an opposing compression force 15 of this compression spring (Both the spring and the force are schematically represented), so that the retaining state of FIG. 1 is the de-energised neutral state.

Compared with the state of FIG. 1, FIG. 2 shows the, energised state of the coil unit 28 (all other reference symbols, i.e. components thereby designated, apply in this respect in an analogous manner; the same is true for the later figures). It can be seen that the coil magnetic field (not shown) displaces the permanent magnetic flux 30' (bundle of arrows in FIG. 2) from the end section 32, i.e. from the first yoke section, so that the permanent magnet can no longer exert any retaining force on the armature unit 14. Accordingly the spring force acting on the armature unit at this point in time in the operation exceeds any retaining force, so that with a further passage of time the armature unit in its direction of movement (downwards in the figure) can be brought into an engagement position, where an engagement end 34 of the armature unit 14 can come into engagement with a related positioning partner (schematically illustrated in FIG. 3 at element 17), for example a positioning groove of a camshaft adjustment system of a combustion engine, and can effect the desired positioning operation.

In a direct comparison with FIG. 2 the schematic view of FIG. 3 illustrates an energised control state of the coil unit 28, of reverse polarity compared with the energisation state of FIG. 2. In this operating state an electromagnetically generated coil magnetic flux 40 runs parallel, i.e. overlapping, with the permanent magnetic flux 30, illustrated by the double arrows shown, acts in this respect so as to increase the flux and therewith the force. Particularly preferably, through suitable control or adjustment agents of the coil unit, this is a pre-selectable mode, if, for example, a particularly strong retaining force is to be exerted on the armature unit (the state shown in FIG. 3); additionally or alternatively even the armature unit against a corresponding compression force of the compression spring unit (not shown)—is to be restored into the initial state shown in FIG. 1 and FIG. 3. In this respect the inventive reversal of polarity of the coil unit also enables a suitable mono-stable or bi-stable switching characteristic for the actuator device. The different directions of polarization are illustrated in FIGS. 2 and 3 by the symbols 19 and 21.

Figure 5:
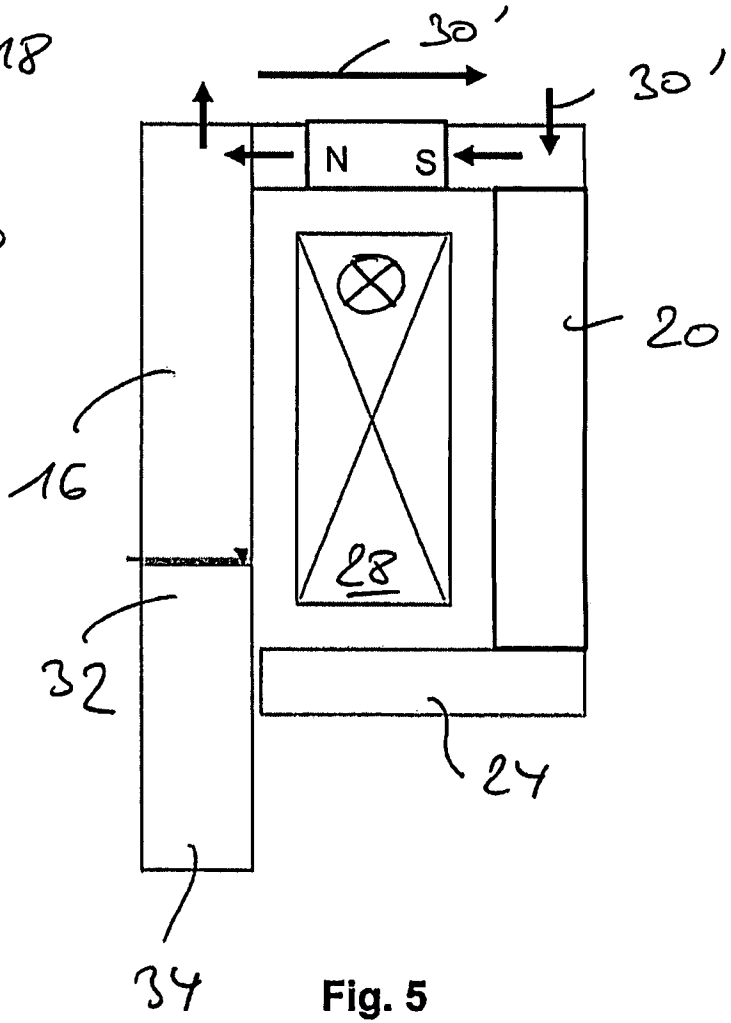
Figure 4:
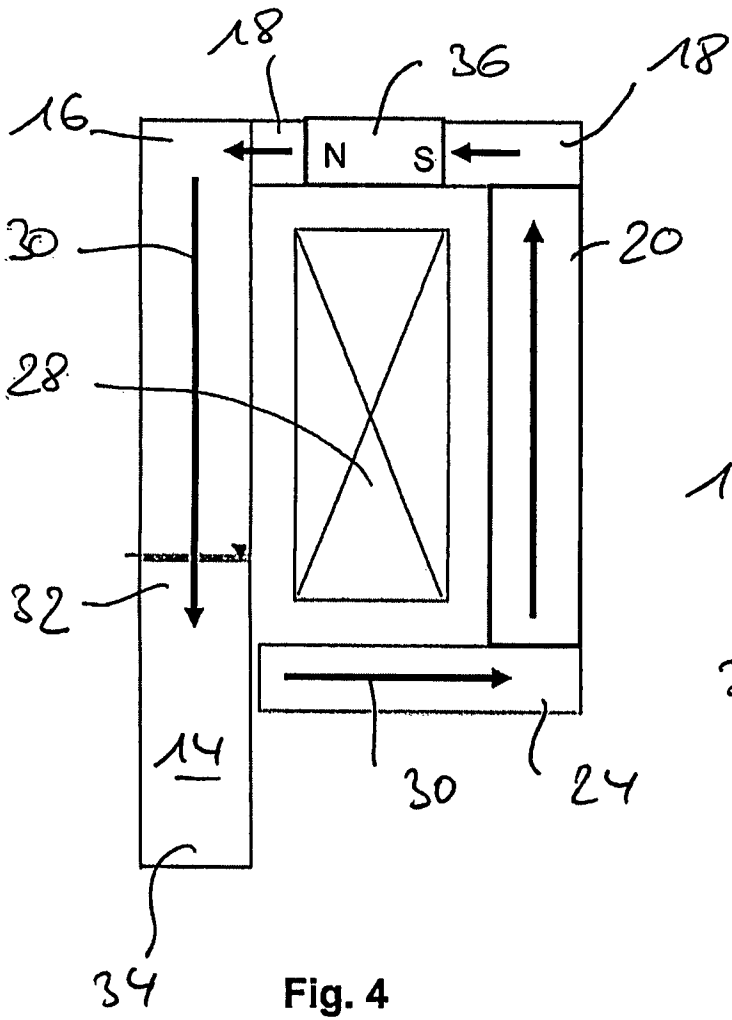
FIGS. 4/5: show schematic views of an electromagnetic actuator device of a second example of embodiment with a permanent magnetic unit provided in the housing front face in the de-energised state (FIG. 4) and in the energised displacement state (FIG. 5) respectively.

FIGS. 4 and 5 show a second example of embodiment of the present invention; once again reference symbols that are the same as those in FIGS. 1 to 3 illustrate identical or equivalent functional components, wherein once again FIG. 4 illustrates the de-energised state and FIG. 5 illustrates the energised functionality effecting the inventive displacement from the armature tappet.

As FIG. 4 illustrates in comparison to FIG. 1, here the permanent magnetic unit 36 shown is provided in the upper or first front face end section 18, once again with the rotational symmetry of the device the unit 36 would therewith correspond to e.g. a ring, which is inserted into a disk-shaped front face 18 and here, in terms of the flux, is coupled in a suitable manner. Additionally or alternatively, as in the first example of embodiment, the permanent magnetic unit can be a single body, or a multiplicity of bodies, which for example in the manner shown magnetised parallel to one another in the magnetic circuit and correspondingly is/are inserted into a mechanical void in the body.

In the an analogous manner to the permanent magnetic flux of FIG. 1 the permanent magnetic flux of the permanent magnet 36 runs through the yoke-side end section 32 of the tappet unit 14, and in this respect closes the permanent magnetic circuit with the formation of a retaining force exceeding the spring force of the spring agents (schematically shown at 15 in FIG. 2). The energisation state, FIG. 5, once again causes the displacement of the permanent magnetic flux 30' from this end section 32, so that the spring agents, suitably acting on the armature unit, can with their pre-loading move the armature unit out of the neutral position shown into its engagement position, downwards along an armature direction of movement in the plane of the figure.

Figure 6:
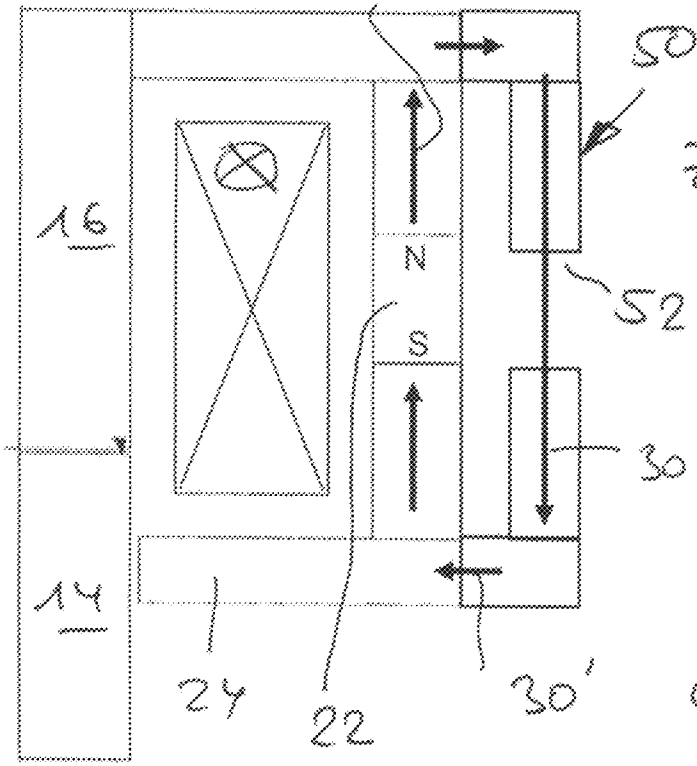
FIG. 6 shows a schematic representation of a third form of embodiment of the electromagnetic actuator device as a further development of the example of embodiment of FIGS. 1 to 3, with an additional flux-conducting unit, with air gap, adjacent to the permanent magnetic unit.

As a variant to the example of embodiment of FIGS. 1 to 3 and as a third form of embodiment, FIG. 6 illustrates how, for purposes of further and additional influencing of the flux, for example in the form of a magnetic shunt, the form of embodiment of FIGS. 1 to 3 is assigned to an additional magnetic circuit section, which consists of the e.g. U-shaped flux conducting section 50, which has centrally an air gap 52 for purposes of increasing the magnetic resistance of this shunt, in this respect so as not to short-circuit the permanent magnetic flux of the permanent magnet unit 22 in every operating state. Such a further development enables the targeted influencing of the field displacement, namely into the shunt frame defined by section 50 and air gap 52 so that by this means a way is enabled to influence a magnetic characteristic of the device in a targeted manner.

Figure 7:
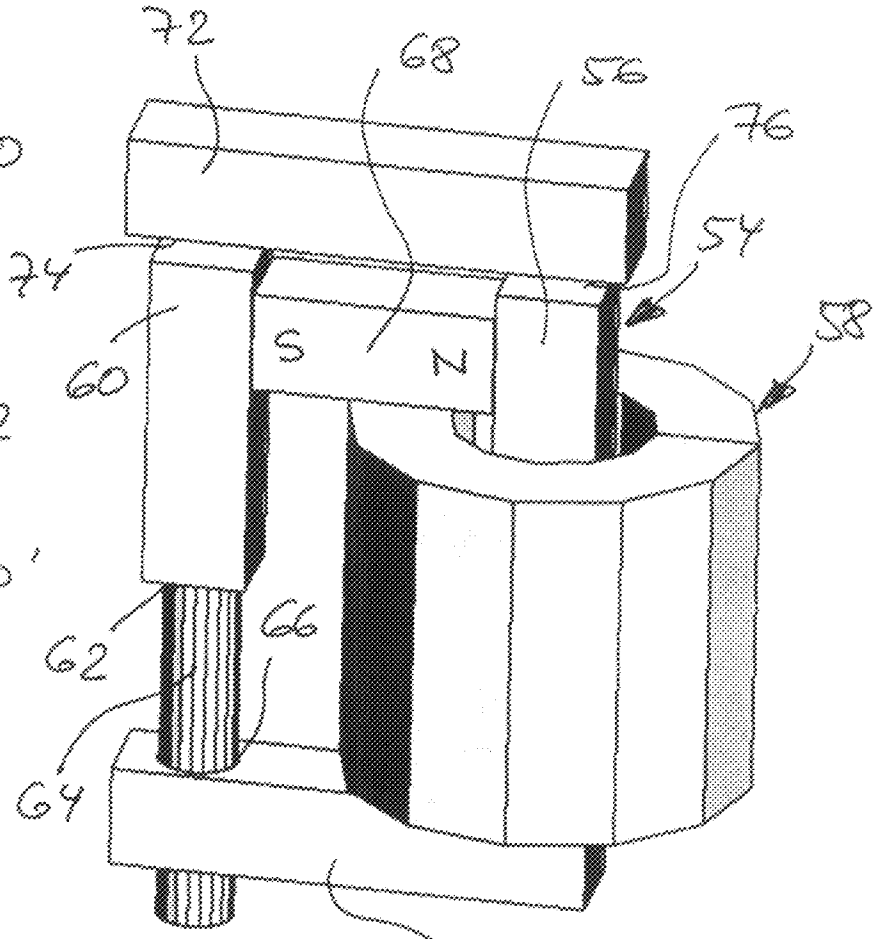
FIG. 7 shows a fourth form of embodiment of the present invention with a coil unit mounted on the edge, and in turn a flux-conducting unit assigned to the permanent magnetic unit.

FIG. 7 shows with the fourth example of embodiment of the invention a further variant for the implementation of a practically usable electromagnetic actuator device. In principle comparable with the second example of embodiment of FIGS. 4, 5, here a stationary U-shaped arm is created as a yoke frame or unit 54, with a first yoke section 56 (extending vertically), around which the coil unit 58 is formed. Laterally adjacent to the yoke section 56 is provided a further yoke section 60, which interacts with an extended actuator unit 64 axially and via an air gap 62. Once again the magnetic flux circuit of a permanent magnetic section 68 provided between the sections 60 and 56 is closed via an air gap 66 by means of a front face flux-conducting element 70, which connects the first yoke section 56 (across the air gap 66) to the actuator or armature unit 64. Additionally and in this respect in accordance with the principle of the example of embodiment of FIG. 6, a magnetic shunt element 72 is assigned to the adjacent permanent magnetic unit 68, which across suitable air gaps 74, 76 provides space for the inventive flux displacement.

Figure 9:
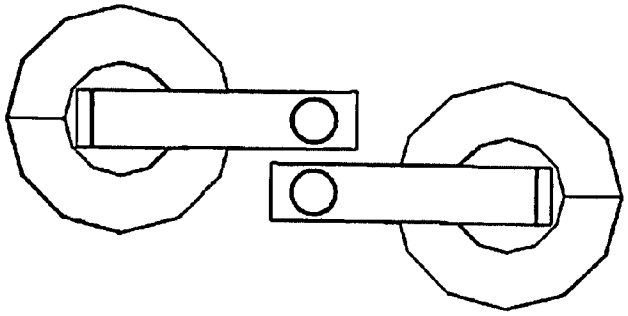
FIGS. 8-10: show various variants for space-saving (compact) arrangements of a multiplicity of electromagnetic actuator devices of the example of embodiment of FIG. 7, in order in a particular installation context to enable deployment conditions that are as compact as possible.
Figure 8:
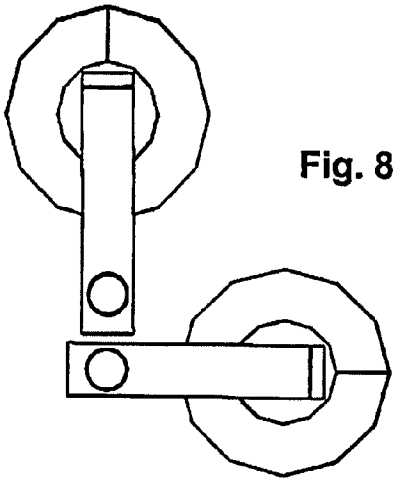
Figure 10:
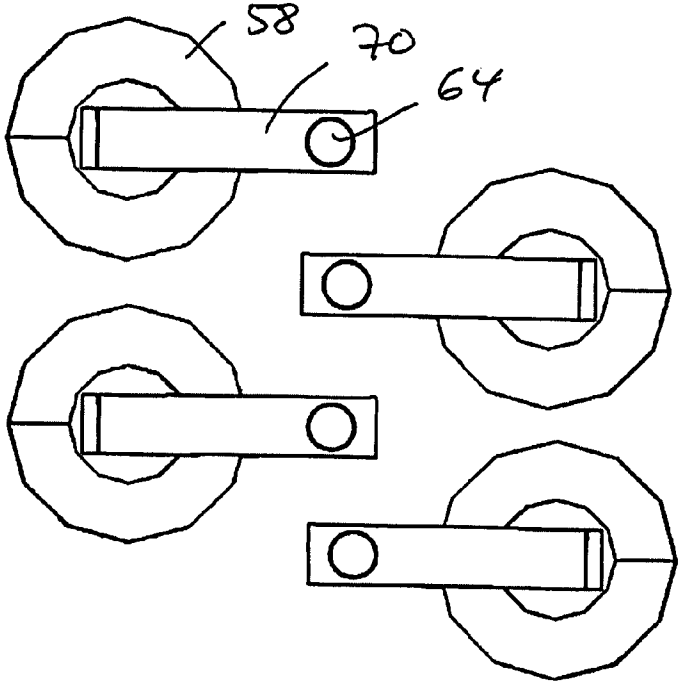

In particular the form of implementation of FIG. 7, with the eccentric coil unit 58 opposite the armature tappet unit (64 in FIG. 7), offers the possibility of assigning a multiplicity of such units in a compact, space-saving manner, and, for example, with the objective of implementing as short a separation distance as possible between adjacent tappet units. Such configurational options are shown in the schematic representations of FIGS. 8 to 10, which in this respect in each case indicate plan views onto the example of embodiment of FIG. 7, and, for example, in the example of FIGS. 8 and 9, illustrate how closely, in actual fact, a multiplicity of tappet units can be operated adjacent to one another, in order, for example, in a particular application context to be able also to solve a corresponding multiplicity of adjustment tasks.

The invention claimed is:

1. An electromagnetic actuator device, comprising:

a stationary yoke unit (10, 54) having a first yoke section (16, 56) and an armature unit (14, 64) which is moveable relative to the stationary yoke unit (10, 54);

a coil unit (28, 58) enclosing the first yoke section (16, 56), wherein the coil unit is operable in an energized or de-energized state;

permanent magnetic means (22, 36, 68) positioned on the yoke unit (10, 54) to generate a magnetic flux circuit which, when the coil unit (28, 58) is operated in the de-energized state, attracts the armature unit (14) toward the first yoke section (16, 56); and a spring exerting a spring force on the armature unit opposed to force of the permanent magnetic means, wherein when the coil unit is operated in the de-energized state, the magnetic flux circuit holds the armature unit (14) in a first position against the spring force, and when the coil unit is operated in the energized state, the magnetic flux circuit is moved out of the first yoke section and the armature unit such that the spring force moves the armature unit away from the first yoke section, wherein the permanent magnetic means (22, 36, 68) are integrated on a cover side or front face of a housing which is at least partially of hollow cylindrical shape that implements the yoke unit (10, 54) and additional yoke sections (20), wherein the permanent magnetic means (22) is connected at one end to one of the additional yoke sections, and connected at an opposed end to another of the additional yoke sections, wherein the armature unit (14) is substantially parallel to the additional yoke sections (20), wherein a central axis of the housing runs axially with or parallel to a longitudinal axis of the armature unit (14, 64), or is integrated into the yoke unit, and wherein the force of the permanent magnetic means is greater than the spring force of the spring.

2. The device in accordance with claim 1, wherein the first yoke section runs parallel to the longitudinal axis of the armature unit.

3. The device in accordance with claim 1, wherein the permanent magnetic means (22, 36, 68) are designed as cylindrical bodies or a cylindrical section of a permanent magnetic material, and are integrated into the cylindrical wall of the housing in a flux-conducting manner, or wherein the permanent magnetic means (22, 36, 68) are designed as a disk or a disk section of a permanent magnetic material, and are integrated into a front face of the housing in a flux-conducting manner, or both.

4. The device in accordance with claim 1, wherein the permanent magnetic means (22, 36, 68) are designed as a rod-shaped or a strip-shaped body of a permanent magnetic material, or both rod-shaped and strip-shaped bodies of a permanent magnetic material.

5. The device in accordance with claim 1, wherein the yoke unit comprises flux-conducting sections adjacent to the permanent magnetic means (22, 36, 68), said flux-conducting sections defining an air gap (12, 26, 52, 62, 66, 74, 76).

6. The device in accordance with claim 1, wherein the first yoke section (16, 56) is aligned axially or orthogonally relative to the armature unit (14, 64), with the formation of an intermediate air gap (12, 26, 52, 62, 66, 74, 76) between them.

7. The device in accordance with claim 1, wherein the coil unit (28, 58) has a first energisation polarity which displaces the magnetic flux circuit from the armature unit (14, 64) and has an opposing second energisation polarity which generates an electromagnetic flux in the same direction as the magnetic flux circuit.

8. The device in accordance with claim 7, wherein the coil unit is further operable in a reverse mode wherein energization of the coil is adjusted by reversing polarity.

9. The device in accordance with claim 1, wherein the coil unit (28, 58) comprises a multiplicity of individual coils provided on sections of the yoke unit (10, 54) and electrically connected together.

10. The device in accordance with claim 1, wherein the armature unit is elongated and in the form of a tappet for interacting with a positioning partner in the form of a combustion engine unit.

11. The device in accordance with claim 10, wherein the combustion engine unit is a camshaft adjustment unit.

* * * * *